US011289009B2

(12) United States Patent
Hu et al.

(10) Patent No.: US 11,289,009 B2
(45) Date of Patent: Mar. 29, 2022

(54) PIXEL DRIVING CIRCUIT, DRIVING METHOD, AND DISPLAY APPARATUS

(71) Applicants: BEIJING BOE OPTOELECTRONICS TECHNOLOGY CO., LTD., Beijing (CN); BOE Technology Group Co., Ltd., Beijing (CN)

(72) Inventors: Guofeng Hu, Beijing (CN); Zhenkun Song, Beijing (CN); Ming Chen, Beijing (CN); Lingyun Shi, Beijing (CN); Yuxin Bi, Beijing (CN); Xin Duan, Beijing (CN); Yankai Gao, Beijing (CN); Hong Liu, Beijing (CN); Mingjian Yu, Beijing (CN)

(73) Assignees: BEIJING BOE OPTOELECTRONICS TECHNOLOGY CO., LTD., Beijing (CN); BOE Technology Group Co., Ltd., Beijing (CN)

( * ) Notice: Subject to any disclaimer, the term of this patent is extended or adjusted under 35 U.S.C. 154(b) by 150 days.

(21) Appl. No.: 16/755,666

(22) PCT Filed: Oct. 25, 2019

(86) PCT No.: PCT/CN2019/113234
§ 371 (c)(1),
(2) Date: Apr. 13, 2020

(87) PCT Pub. No.: WO2020/244129
PCT Pub. Date: Dec. 10, 2020

(65) Prior Publication Data

US 2021/0407378 A1 Dec. 30, 2021

(30) Foreign Application Priority Data

Jun. 3, 2019 (CN) ..... 201910476712.3

(51) Int. Cl.
*G09G 3/32* (2016.01)
*G09G 3/20* (2006.01)

(52) U.S. Cl.
CPC ..... *G09G 3/32* (2013.01); *G09G 3/2014* (2013.01); *G09G 2300/0857* (2013.01); *G09G 2310/027* (2013.01); *G09G 2320/0626* (2013.01)

(58) Field of Classification Search
CPC ..... G09G 3/32; G09G 3/2014; G09G 2300/0857; G09G 2310/027; G09G 2320/0626
See application file for complete search history.

(56) References Cited

U.S. PATENT DOCUMENTS 5,929,835 A 7/1999 Sakamoto
6,069,451 A 5/2000 Hush et al.
(Continued)

FOREIGN PATENT DOCUMENTS

CN 1710964 A 12/2005
CN 2927593 Y 7/2007
(Continued)

OTHER PUBLICATIONS

International Search Report & Written Opinion dated Feb. 21, 2020, regarding PCT/CN2019/113234.
(Continued)

*Primary Examiner* — Muhammad N Edun
(74) *Attorney, Agent, or Firm* — Intellectual Valley Law, P.C.

(57) ABSTRACT

A pixel driving circuit for a light-emission-device-based display panel is provided, including a driving transistor coupled to a light-emission device per subpixel; a digital-driving circuit having a first input terminal configured to receive a pixel voltage signal corresponding to a grayscale
(Continued)

level of a subpixel image to be displayed and a first output terminal coupled to a gate terminal of the driving transistor. The digital-driving circuit is configured to convert the pixel voltage signal to a digital signal and transform the digital signal to a pulse-width-modulation (PWM) signal outputted via the first output terminal to the gate terminal of the driving transistor. The PWM signal comprises a pulse width proportional to the grayscale level as a duty cycle in a period of driving the light-emitting device to display subpixel image.

16 Claims, 10 Drawing Sheets

(56) References Cited

U.S. PATENT DOCUMENTS

| | | | | |
|---|---|---|---|---|
| 10,455,653 | B1 | 10/2019 | Watanabe et al. | |
| 2002/0030647 | A1* | 3/2002 | Hack | G09G 3/3283 345/82 |
| 2012/0044271 | A1 | 2/2012 | Lee et al. | |
| 2017/0039935 | A1 | 2/2017 | Yang et al. | |
| 2017/0186356 | A1 | 6/2017 | Cok | |
| 2018/0182303 | A1* | 6/2018 | Jung | G09G 3/3233 |
| 2020/0329536 | A1* | 10/2020 | Chilukuri | H05B 45/12 |
| 2021/0298138 | A1* | 9/2021 | Bonne | B60Q 1/143 |

FOREIGN PATENT DOCUMENTS

| | | | |
|---|---|---|---|
| CN | 101620826 | A | 1/2010 |
| CN | 102664524 | A | 9/2012 |
| CN | 103177678 | A | 6/2013 |
| CN | 103606362 | A | 2/2014 |
| CN | 204390687 | U | 6/2015 |
| CN | 106205454 | A | 12/2016 |
| CN | 106469539 | A | 3/2017 |
| CN | 109215569 | A | 1/2019 |
| CN | 109272940 | A | 1/2019 |
| JP | H0736405 | A | 2/1995 |
| JP | 2005265937 | A | 9/2005 |
| KR | 20010096760 | A | 11/2001 |
| KR | 20170022368 | A | 3/2017 |
| TW | 201629935 | A | 8/2016 |
| WO | 2019006957 | A1 | 1/2019 |

OTHER PUBLICATIONS

First Office Action in the Chinese Patent Application No. 201910476712.3 dated May 7, 2020; English translation attached.
Second Office Action in the Chinese Patent Application No. 201910476712.3 dated Jul. 29, 2020; English translation attached.

* cited by examiner

PIXEL DRIVING CIRCUIT, DRIVING METHOD, AND DISPLAY APPARATUS

CROSS-REFERENCE TO RELATED APPLICATION

This application is a national stage application under 35 U.S.C. § 371 of International Application No. PCT/CN2019/113234, filed Oct. 25, 2019, which claims priority to Chinese Patent Application No. 201910476712.3, filed Jun. 3, 2019. Each of the forgoing applications is herein incorporated by reference in its entirety for all purposes.

TECHNICAL FIELD

The present invention relates to display technology, more particularly, to a pixel driving circuit, a driving method, and a display apparatus having the same.

BACKGROUND

Micro LED (Micro Light Emitting Diode) has many advantages as one of next-generation image display technologies, with high contrast fast response, wide view-angle, broad color range, high brightness, low power consumption, long life-time, and high stability.

In related display apparatus based on Micro LED, a typical organic-light-emitting diode (OLED) pixel driving circuit is used to drive the micro LED to emit light per pixel. It controls the pixel brightness by controlling driving current. However, because the color point of the Micro LED can drift with the driving current, making the color coordinates of the Micro LED very unstable under low driving current and thereby causing degraded quality in image display.

SUMMARY

In an aspect, the present disclosure provides a pixel driving circuit for a light-emission-device-based display panel. The pixel driving circuit includes a driving transistor coupled to a light-emission device per subpixel. The pixel driving circuit further includes a digital-driving circuit having a first input terminal configured to receive a pixel voltage signal corresponding to a grayscale level of a subpixel image to be displayed and a first output terminal coupled to a gate terminal of the driving transistor. The digital-driving circuit is configured to convert the pixel voltage signal to a digital signal and transform the digital signal to a pulse-width-modulation (PWM) signal outputted via the first output terminal to the gate terminal of the driving transistor. The PWM signal includes a pulse width proportional to the grayscale level as a duty cycle in a period of driving the light-emitting device to display subpixel image.

Optionally, the digital-driving circuit includes an analog-to-digital converter sub-circuit coupled to the first input terminal to convert the pixel voltage signal corresponding to generate N binary digits respectively to N output terminals combined to form an N-digit binary value corresponding to the grayscale level.

Optionally, the digital-driving circuit further includes a memory sub-circuit having N input terminals and N output terminals. The N input terminals are respectively connected to the N output terminals of the analog-to-digital converter sub-circuit and configured to store the N-digit binary value and output respective binary digits to the N output terminals.

Optionally, the memory sub-circuit includes N memory units Each memory unit includes a buffer connected to one of the N output terminals of the analog-to-digital converter sub-circuit, a D-type flip-flop logic circuit coupled to the buffer, and a tri-state gate logic circuit coupled to the D-type flip-flop logic circuit and configured to output a respective one of the N binary digits to the N output terminals.

Optionally, the digital-driving circuit further includes a pulse-width-modulation sub-circuit including a subtraction counter having N input terminals and N output terminals Each of the N input terminals is configured to receive one binary (0 or 1) digit and each of the N output terminals is configured to output one binary digit (0 or 1). The digital-driving circuit further includes an OR gate logic circuit having N input terminals respectively connected to the N output terminals of the subtraction counter and an output terminal. Additionally, the digital-driving circuit further includes a voltage-adjust sub-circuit having an input terminal connected to the output terminal of the OR gate logic circuit and an output terminal coupled to the first output terminal. The subtraction counter contains M counting pulses within each period of displaying a frame of subpixel image.

Optionally, the N-digit binary value is an 8-digit binary value, and M is 255, a maximum value of the grayscale level represented by the 8-digit binary value.

Optionally, the subtraction counter is configured to subtract the N-digit binary value by one till zero per each counting pulse being counted in the subtraction counter and to output a high voltage level at any of the N output terminals corresponding a non-zero digit or output a low voltage level at any of the N output terminal corresponding a zero digit.

Optionally, the voltage-adjust sub-circuit is configured to adjust the high voltage level outputted at any of the N output terminals to an effective transistor turn-on level outputted to the gate terminal of the driving transistor.

Optionally, the pixel driving circuit further includes a switch transistor having a gate terminal coupled to a scan signal port, a first terminal coupled to a data signal port, and a second terminal coupled to the first input terminal of the digital-driving circuit. Additionally, the pixel driving circuit further includes a storage capacitor having a first terminal coupled to the first input terminal of the digital-driving circuit and a second terminal coupled to a first control terminal.

Optionally, the light-emitting device includes a micro LED. The driving transistor has a first terminal coupled to a first power supply port, a second terminal coupled to a first terminal of the micro LED. The micro LED has a second terminal coupled to a second power supply port.

In another aspect the present disclosure provides a display apparatus including a plurality of subpixels. At least some of the plurality of subpixels are configured with the pixel driving circuits described herein.

Optionally, a respective one of the pixel driving circuits includes a light-emitting device configured as a micro LED.

Optionally, a respective one of the pixel driving circuits includes a digital-driving circuit and a driving transistor both being integrated in a micro chip. Multiple pixel driving circuits are configured to multiple subpixels disposed next to each other.

Optionally, a respective one of the pixel driving circuits includes a digital-driving circuit, a driving transistor, and a micro LED. All of the digital-driving circuit, the driving transistor, and the micro LED are integrated in a micro chip. Multiple pixel driving circuits are configured to multiple subpixels disposed next to each other.

In yet another aspect, the present disclosure provides a driving method for driving a pixel driving circuit described herein. The digital-driving circuit includes an analog-to-digital converter sub-circuit, a memory sub-circuit, and a pulse-width-modulation sub-circuit. The method includes inputting a pixel voltage signal corresponding to a grayscale level. The method further includes converting the pixel voltage signal by the analog-to-digital converter to a digital signal represented by an N-digit binary value corresponding to the grayscale level. Additionally, the method includes storing the N-digit binary value to the memory sub-circuit. Furthermore, the method includes converting the N-digit binary value by the pulse-width-modulation sub-circuit to a pulse width modulation signal. Moreover, the method includes outputting the pulse width modulation signal to a gate terminal of a driving transistor in the pixel driving circuit.

Optionally, the pulse-width-modulation sub-circuit includes a subtraction counter, an OR gate logic circuit, and a voltage-adjust sub-circuit. The step of converting the N-digit binary value to a pulse width modulation signal includes receiving each digit of the N-digit binary value from the memory sub-circuit. The step of converting the N-digit binary value to a pulse width modulation signal further includes subtracting each digit by one per each counting pulse in the subtraction counter till the digit reaches zero. Additionally, the step of converting the N-digit binary value to a pulse width modulation signal includes outputting an output signal at a high voltage level or a low voltage via the OR gate logic circuit whenever a digit in a respective one of N output terminals of the subtraction counter is not zero or is reduced to zero.

Optionally, the step of outputting the pulse width modulation signal to a gate terminal of a driving transistor includes receiving the output signal from the OR gate logic circuit by the voltage-adjust sub-circuit. The step of outputting the pulse width modulation signal to a gate terminal of a driving transistor further includes adjusting the high voltage level to an effective transistor turn-on voltage level to generate a pulse width modulation signal having a pulse width proportional to the grayscale level as a duty cycle in a period of displaying a frame of subpixel image. Furthermore, the step of outputting the pulse width modulation signal to a gate terminal of a driving transistor includes outputting the pulse width modulation signal to the gate terminal of the driving transistor.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

For an improved display apparatus, especially ones that are based on micro light-emitting diode (Micro LED), the present disclosure provides, inter alia, a display-driving apparatus for driving pixel driving circuit of a display panel, a driving method, and a display apparatus having the same that substantially obviate one or more of the problems due to limitations and disadvantages of the related art. In one aspect, the present disclosure provides a display apparatus including at least a display panel. In general, the display apparatus can be one selected from a television, a smart phone, a computer, a notebook computer, a tablet computer, a personal digital assistant (PDA), a car-based computer, and any product or component having a display function. Additionally, the display apparatus includes a circuit board, a display-driving integrated circuit (LC) and other auxiliary electronic devices.

In an embodiment, the display panel can include an organic light emitting diode (PLED) display panel, or a quantum dot light emitting diodes (QLED) display panel, or a micro light emitting diodes (Micro LED) display panel.

Figure 1:
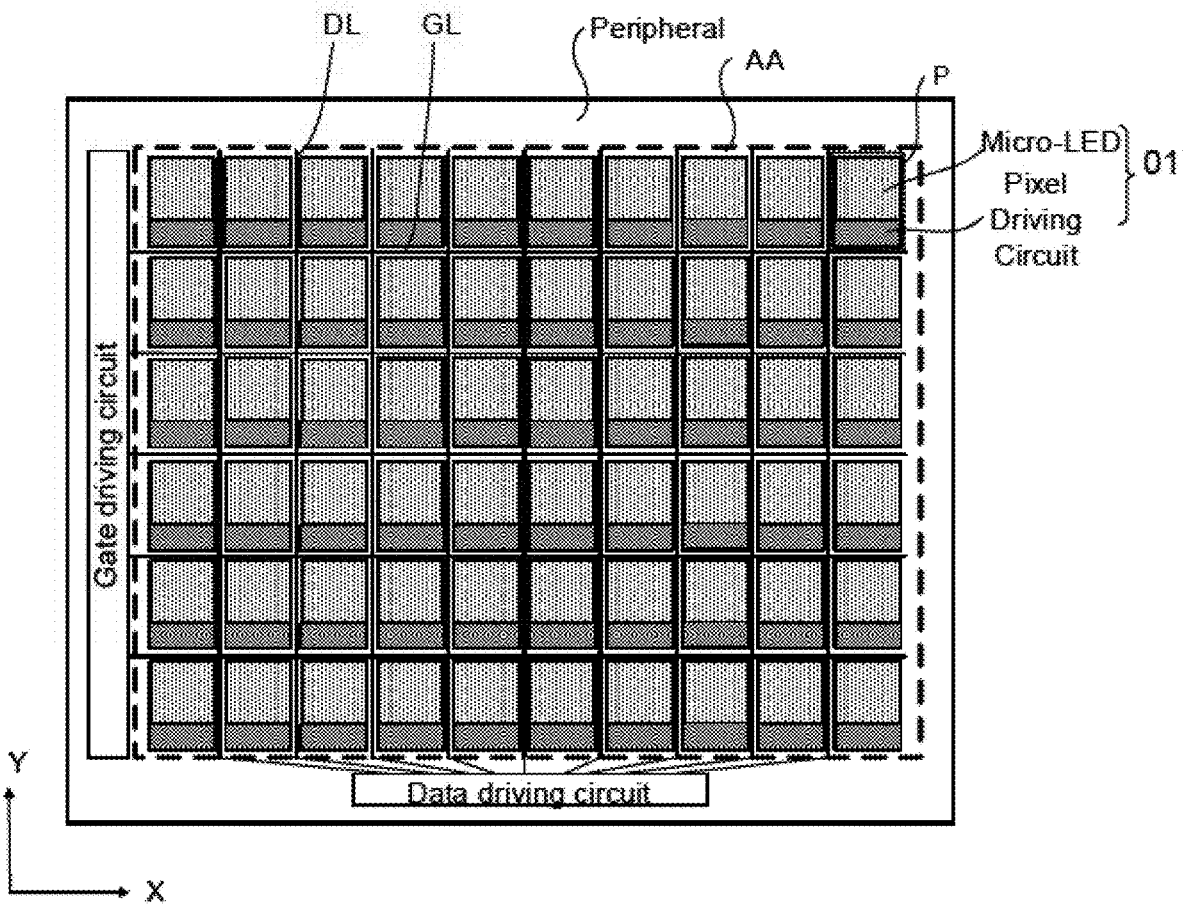
FIG. 1 is a schematic diagram of a display panel containing multiple pixels according to an embodiment of the present disclosure.

FIG. 1 is a schematic diagram of a display panel containing multiple pixels according to an embodiment of the present disclosure. Referring to FIG. 1, the display panel includes active area (AA) winch is an effective display region and a Peripheral area surround the AA. The AA in the display panel includes multiple subpixels P of various colors including at least a first color subpixel, a second color subpixel, and a third color subpixel. Optionally, the first color, the second color, and the third color are Trichromatic colors like red, green, and blue.

For a simplified illustration, FIG. 1 shows that the multiple subpixels P are arranged in rectangular matrix configuration. Along x direction, multiple subpixels P form one row and along y direction multiple subpixels P form one column in the matrix.

Referring to the display panel in FIG. 1, each subpixel P is configured with a pixel driving circuit 01. The pixel driving circuit 01 includes a Micro LED and a driving circuit for driving the Micro LED to work for image display. Further, the display panel is configured to dispose gate driving circuit and data driving circuit in its Peripheral area. In some embodiments, the gate driving circuit is placed at one side in an extended direction (e.g., x direction) of multiple gate fines GL. The data driving circuit is then placed at one side in an extended direction (e.g., y direction) of multiple data lines DL. The gate driving circuit inputs scan signals line-by-line to each of the multiple gate lines to sequentially turn on respective pixel driving circuit 01. When a respective pixel driving circuit 01 is turned on, the data driving circuit is configured to write pixel voltages through the multiple data lines DL to drive the Micro LED to emit light to realize an image display thereof.

In some embodiments, each pixel driving circuit 01 includes a driving transistor for controlling the Micro LED, by controlling a driving current flown through, to emit light. In the related technology, the driving current flown through the Micro LED is controlled by controlling voltage level applied to a gate terminal of the driving transistor. By controlling different driving ament flown through the Micro LED, different light emission intensities thereof can be achieved yielding different grayscale levels (for the corresponding subpixel). However, color coordinates of the light emission by the Micro LED within the Trichromatic colors system can be drifted with the changes of the driving current and become very unstable especially when the driving current is a small current value, thereby causing poor display quality.

Figure 2:
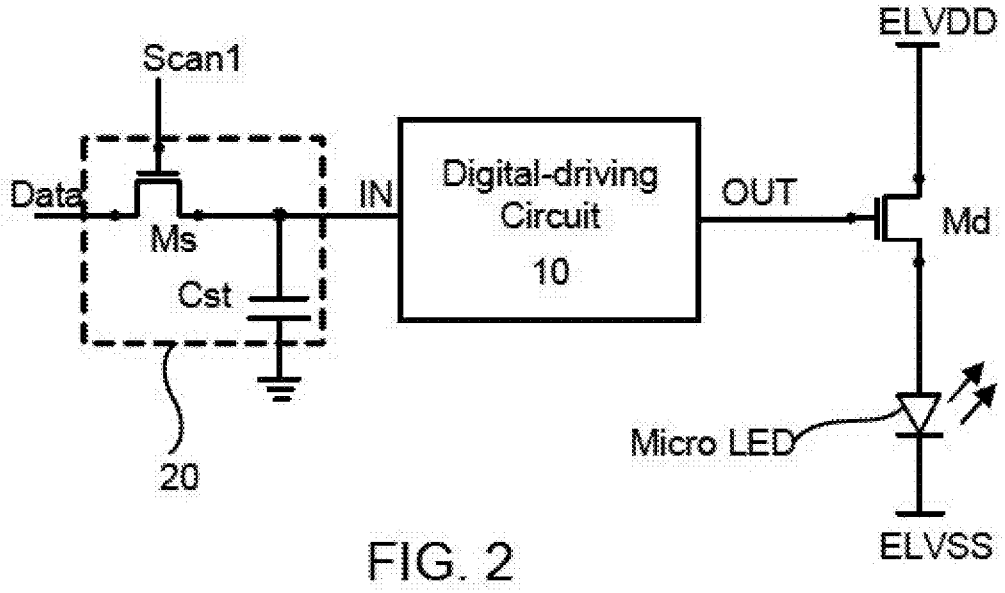
FIG. 2 is a schematic diagram of a pixel driving circuit according to an embodiment of the present disclosure.

FIG. 2 is a schematic diagram of an improved pixel driving circuit according to an embodiment of the present disclosure. Referring to FIG. 2, the pixel driving circuit 01 includes, in addition to the driving transistor Md, a digital-driving circuit 10 having a first input terminal IN and a first output terminal OUT. The first input terminal IN is used to receive pixel voltage signal. The first output terminal OUT is connected to the gate terminal of the driving transistor Md.

Figure 3:
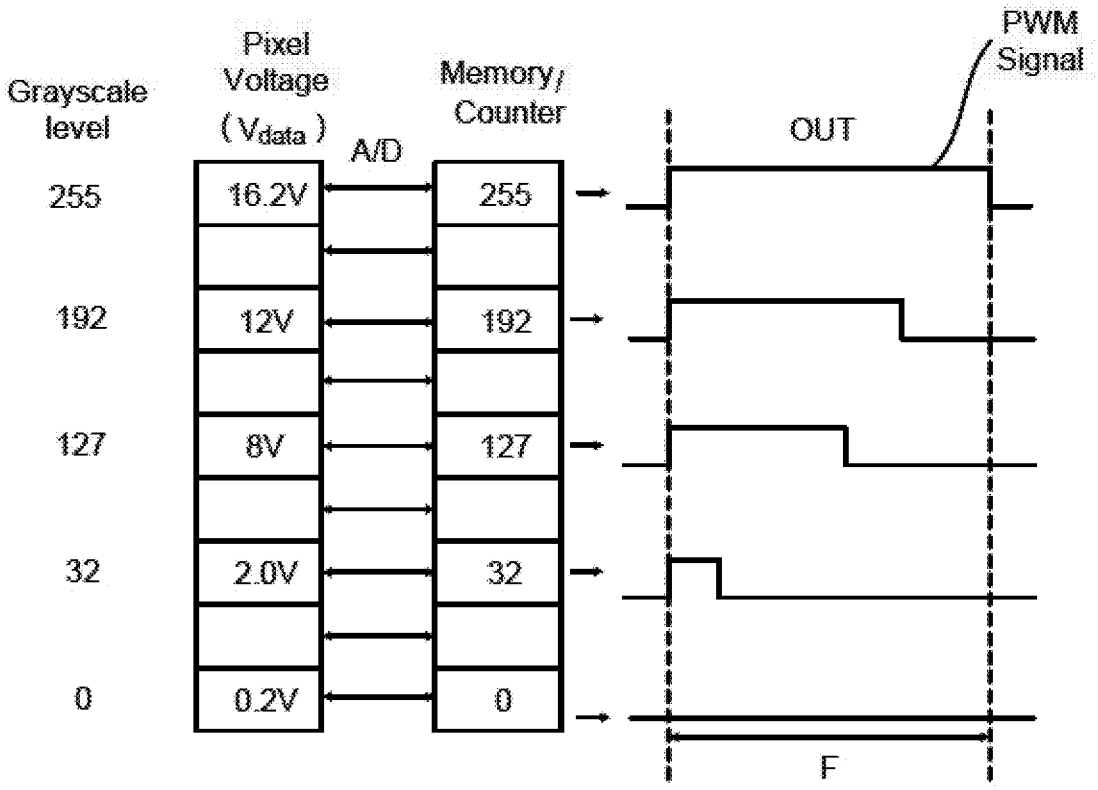
FIG. 3 is a schematic diagram of converting a pixel voltage corresponding to a grayscale level to a pulse width modulation (PWM) signal according to an embodiment of the present disclosure.

Further shown in FIG. 3, a schematic diagram of the digital-driving circuit is shown according to an embodiment of the present disclosure. The digital-driving circuit 10 is configured to convert a pixel voltage signal Vdata received by the first input terminal IN to an N-digit digital signal equal a grayscale corresponding to the pixel voltage signal. Here N is a positive integer. Further, the digital-driving circuit 10 is configured to convert the N-digit digital signal to a pulse width modulation (PWM) signal and to output the PWM signal via the first output terminal OUT to the gate terminal of the driving transistor Md. Optionally, the N-digit digital signal is setup based on display format selected for the display panel. Optionally, the N-digit digital signal is represented by an N-digit binary value equal to the grayscale level.

For example, for a display panel adopting 0-255 full grayscale levels, the N-digit digital signal converted by the digital-driving circuit 10 is an 8-digit binary signal. Alternatively, for a display panel adopting 127 full grayscale levels, the N-digit digital signal is a 7-digit binary signal. Here, 8-digit signal for the display panel configured with 0-255 full grayscale levels is described as an embodiment of the present disclosure.

In an embodiment, the pixel voltage signal Vdata and the PWM signal converted from the pixel voltage signal corresponds to a same grayscale level (i.e., image grayscale level). Different PWM signals converted from pixel voltage signals with different grayscale levels at respective subpixels are characterized by different duty cycles in a period of displaying one frame of subpixel image. In particular, the period of the PWM signal is set to be same as the period of displaying one frame of image in the display panel. In an embodiment, the PWM signal obtained by a digital-driving circuit 10 associated with a subpixel is configured as a driving signal pulse with a pulse height being kept constant while a pulse width being set to a duty cycle of the signal period for controlling brightness of the subpixel Different duty cycles correspond to different, grayscale levels representing the brightness of the subpixel.

As the digital-driving circuit 10 of a subpixel converts the pixel voltage signal Vdata to a digital signal D, further transforms the digital signal D to a PWM signal corresponding to a same grayscale level as the pixel voltage signal, and outputs the PWM signal to the gate terminal of the driving transistor Md of the subpixel, the driving current flowing through the driving transistor Md is a current being kept constant flowing through a light-emitting device (e.g., a Micro LED) coupled to the driving transistor. Because the duty cycle of the PWM signal not the driving current is used to control light emission strength of the Micro LED, the poor image quality issue with unstable color-coordinates caused by drifting current is avoided.

Referring to FIG. 2, the driving transistor Md has a first terminal directly coupled to a first power supply ELVDD, a second terminal coupled to a first terminal (anode) of the Micro LED. The Micro LED has a second terminal (cathode) connected to a second power supply ELVSS. Optionally, the pixel driving circuit 01 includes a charging circuit 20 connected to a data signal terminal Data, a scan signal terminal Scan1, and the first input terminal IN of the digital-driving circuit 10. Optionally, the pixel driving circuit 01 can includes other functional components other than the driving transistor Md and the digital-driving circuit 10 depending on specific application requirements. Referring to FIG. 2, the charging circuit 20 includes a switch transistor Ms and a storage capacitor Cst. The switch transistor Ms has a gate terminal connected to the scan signal terminal Scan1, a first terminal connected to the data signal terminal Data, and a second terminal connected to the first input terminal IN of the digital-driving circuit 10. The storage capacitor Cst has a first terminal connected to the first input terminal IN of the digital-driving circuit 10 and a second terminal connected to a first control terminal. The first control terminal can be grounded. Optionally, the first control terminal can be a first terminal or a second terminal of the driving transistor Md.

In some embodiments, the pixel driving circuits of subpixels in a same row are connected to a same gate line GL through the scan signal terminal Scan1. The pixel driving circuits of subpixels in a same column are connected to a same data line DL through the data signal terminal Data.

Figure 4:
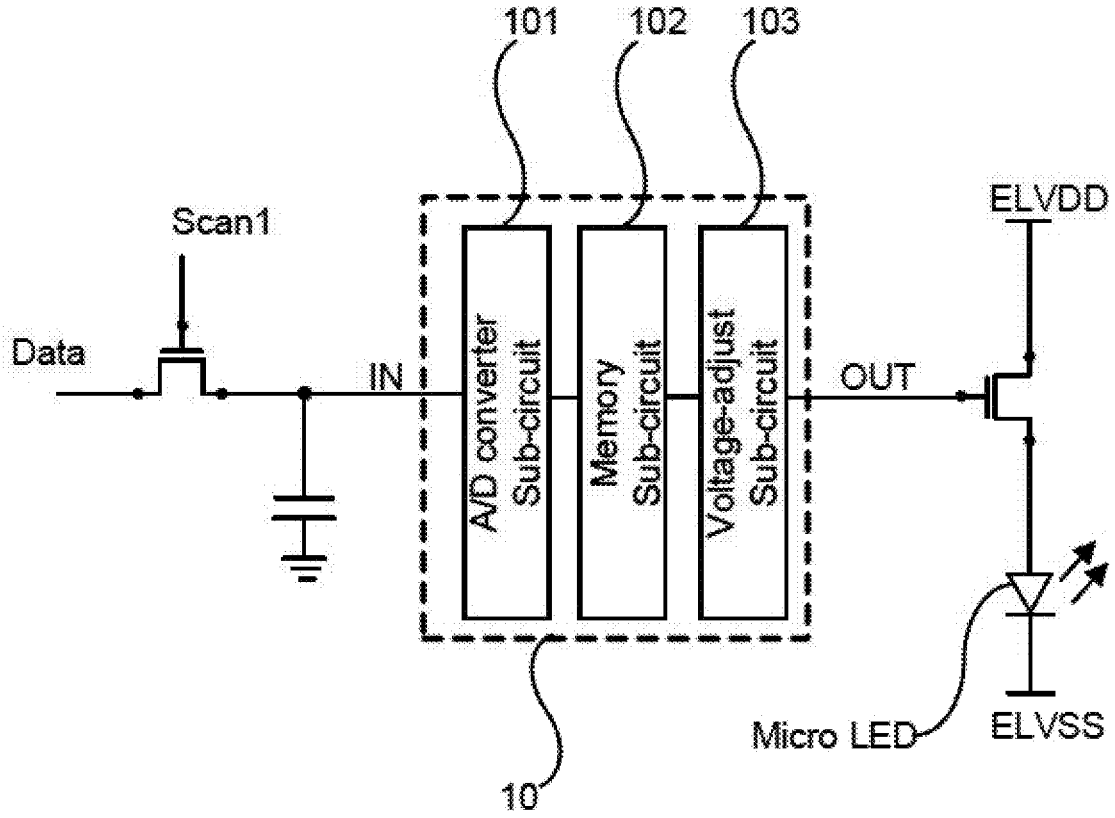
FIG. 4 is a schematic diagram of a pixel driving circuit according to an embodiment of the present disclosure.

FIG. 4 shows an embodiment of the digital-driving circuit including an analog-to-digital convertor (ADC) sub-circuit 101, a memory sub-circuit 102, and a pulse-width-modulation sub-circuit 103 connected in series. Referring to FIG. 4, the ADC sub-circuit 101 is set with an input terminal connected to the first input terminal IN and an output terminal connected to an input terminal of the memory sub-circuit 102. The memory sub-circuit 102 has an output terminal connected to an input terminal of the pulse-width-modulation sub-circuit 103 which has an output terminal connected to the first output terminal OUT.

In the embodiment, the ADC sub-circuit 101 is configured to convert the pixel voltage signal Vdata inputted from the first input terminal IN to an N-digit digital signal whose value is equal to the grayscale level corresponding to the pixel voltage signal Vdata. In an example, the N-digit signal is an 8-digit binary value. The ADC sub-circuit 101 outputs the N-digit digital signal to the memory sub-circuit 102. The memory sub-circuit 102 stores the N-digit digital signal and outputs the N-digit digital signal to the pulse-width-modulation sub-circuit 103, wherein the N-digit digital signal is converted to the PWM signal.

Figure 5:
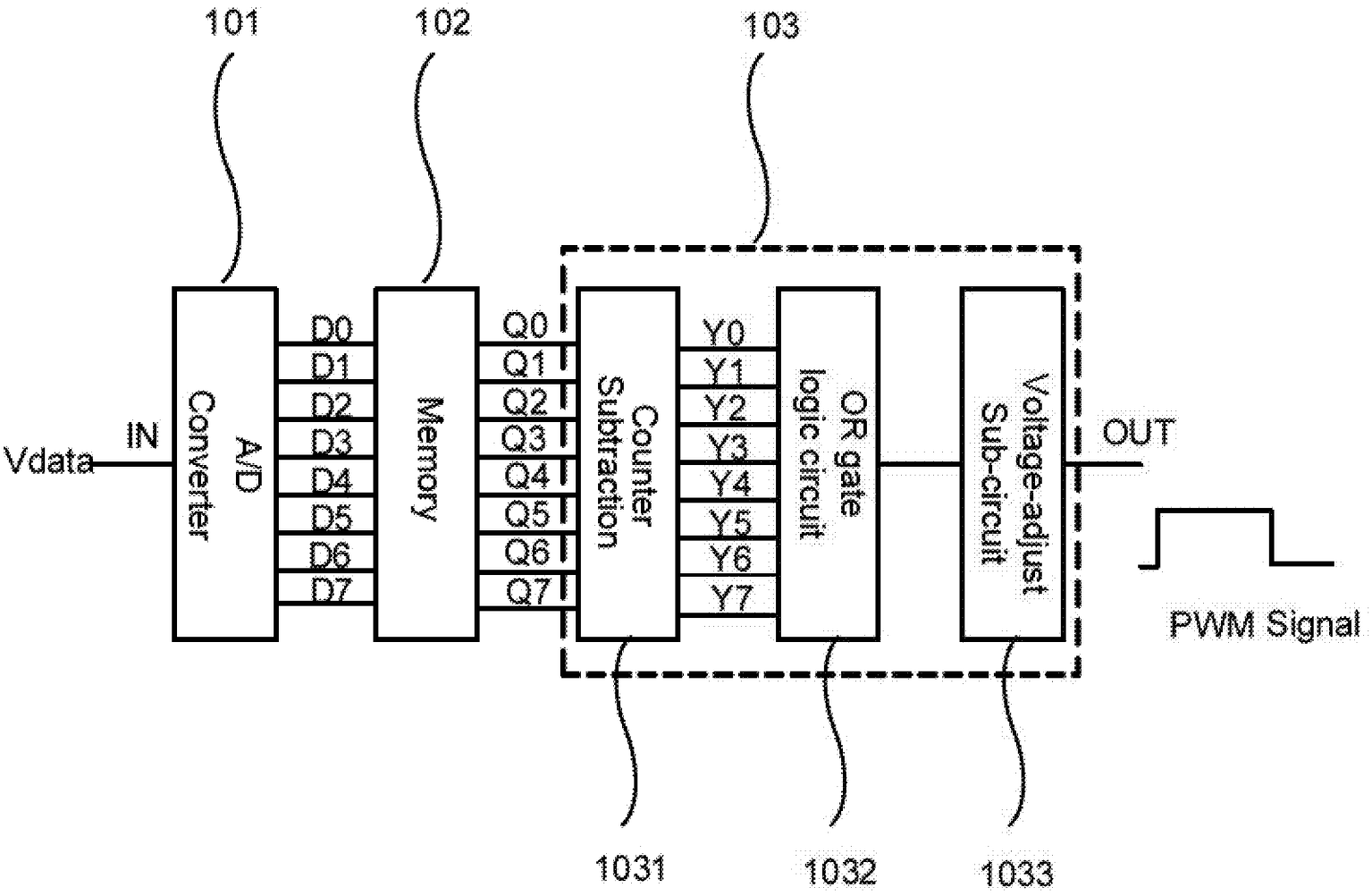
FIG. 5 is a schematic diagram of a digital-driving circuit in the pixel driving circuit according to an embodiment of the present disclosure.

FIG. 5 shows a schematic diagram of a digital-driving circuit in the pixel driving circuit according to an embodiment of the present disclosure. Referring to FIG. 5, the ADC sub-circuit 101 has N=8 digital-signal output terminals: D0, D1, . . . , D7. The memory sub-circuit 102 is a logic circuit configured with multiple (e.g., 8) memory units to store digital signals. In particular, the memory sub-circuit 102 also has 8 input terminals respectively coupled to the 8 digital-signal output terminals to receive and store respective 8 binary digit values. Further, the memory sub-circuit 102 also is configured to output these binary digit values respectively through 8 output terminals: Q0, Q1, . . . , Q7.

Figure 6:
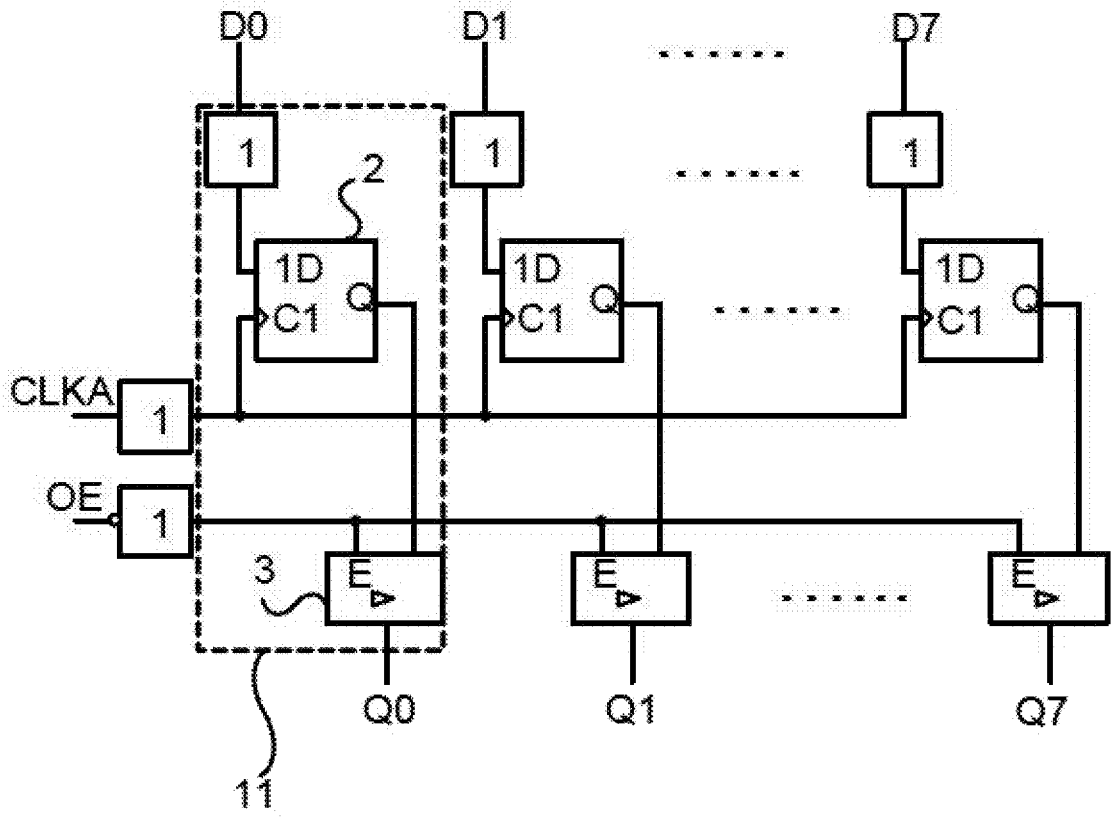
FIG. 6 is a schematic diagram of a memory sub-circuit according to an embodiment of the present disclosure.

FIG. 6 shows an example of the memory sub-circuit including 8 memory units 11 with 8 input terminals respectively coupled with the 8 digital-signal output terminals (D0, D1, . . . , D7) of the ADC. Each memory unit 11 includes a buffer 1 (which is a YES gate), a D-type flip-flop logic circuit 2, and a tri-state gate logic circuit 3. Optionally, the input terminal of the memory unit 11 is connected via the buffer 1 to an 1D terminal of the D-type flip-flop logic circuit 2. Die D-type flip-flop logic circuit 2 has a Q terminal connected to an input terminal of the tri-state gate logic circuit 3. Die tri-state gate logic circuit 3 has an output terminal serving as the output terminal of the memory unit 11, which is one of the 8 output terminals Q0, Q1, . . . , Q7. Additionally, a clock signal terminal CLKA is connected also through the buffer 1 to a C1 terminal of the D-type flip-flop logic circuit 2 in each memory unit 11. An enabling signal terminal OE is connected through an inverter to an enabling terminal of the tri-state gate logic circuit 3 in each memory unit 11.

Referring back to FIG. 5, the pulse-width-modulation sub-circuit 103 is comprised of a subtraction counter 1031, an output sub-circuit 1032, and a voltage-adjust sub-circuit 1033 in an embodiment of the present disclosure. In the embodiment, the subtraction counter 1031 is configured with 8 input terminals and 8 output terminals (Y0, Y1, . . . , Y7). The 8 input terminals of the subtraction counter 1031 are connected respectively to the 8 output terminals Q0, Q1, . . . , Q7 of the memory sub-circuit. Optionally, the subtraction counter 1031 is configured to generate M counting pulses during each period F of displaying one frame of image. Here, M equals to a maximum value of grayscale level (of a subpixel). For example, when N=8, the maximum value of grayscale level is 255 (with minimum value of grayscale level is set to 0), so M=255. The subtraction counter 1031 is operated to respectively make a subtraction of 1 from the 8-digit binary value till the value reaches 0 whenever a counting pulse is passed through. During one counting period, any one of the among all 8 output terminals (Y0, Y1, . . . , Y7) of the subtraction counter 1031 associated with a digit of 0 is configured to output a high-voltage signal and any one associated with a digit of 1 is configured to output a low-voltage signal.

Figure 7:
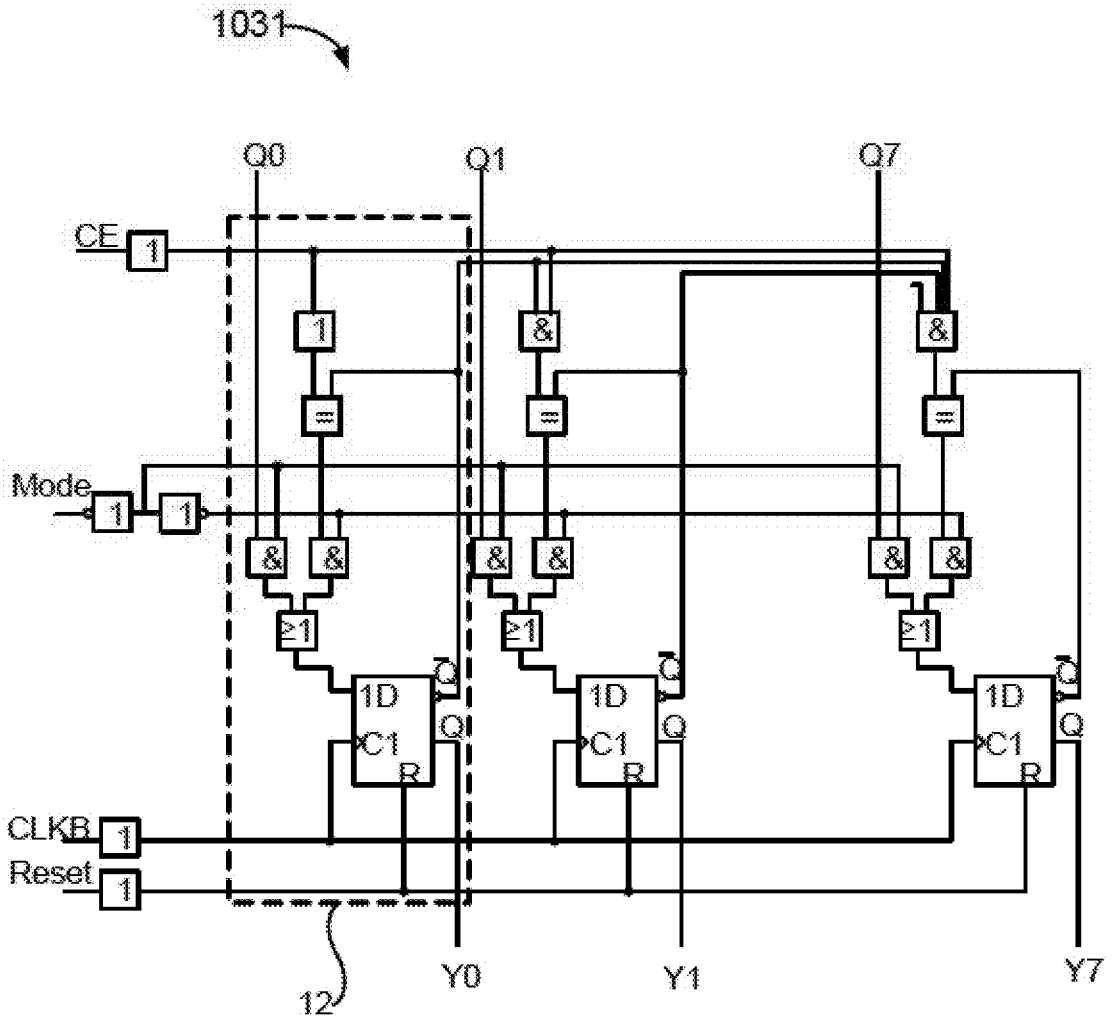
FIG. 7 is a schematic diagram of a subtraction counter according to an embodiment of the present disclosure.

For example, referring to FIG. 7 showing a schematic diagram of a subtraction counter according to an embodiment of the present disclosure, the subtraction counter 1031 includes 8 counting units 12 having their input terminals respectively connected to the 8 output terminals (Q0, Q1, . . . , Q7) of the memory sub-circuit. In the embodiment, each counting unit 12 includes a D-type flip-flop logic circuit. A reset signal terminal Reset is connected through the buffer 1 to a reset terminal R of the D-type flip-flop logic circuit in each counting unit 12. A clock signal terminal CLKB is connected through the buffer 1 to a C1 terminal of the D-type flip-flop logic circuit in each counting unit 12.

The D-type flip-flop logic circuit in each counting unit 12 has a Q terminal serving as one of 8 output terminals. In the embodiment, the D-type flip-flop logic circuit is configured to having a 1D terminal connected to an output terminal of an OR gate (≥1). Thus OR gate (≥1) has two input terminals respectively connected to two output terminals of two AND gates (&). The two AND gates (&) includes a first AND gate (&) and a second AND gate (&). The first AND gate has a first input terminal connected to a corresponding output terminal of the memory sub-circuit. A preset signal terminal Mode is connected through an inverter to a second input terminal of the first AND gate (&) in each counting unit 12. The second AND gate (&) has a first input terminal connected to an output terminal of an XNOR gate (=). The preset signal terminal Mode is connected through two serially-connected inverters to a second input terminal of the second AND gate (&) in each counting unit 12. The XNOR gate (=) has a first input terminal connected to a Q-bar terminal $\overline{Q}$ of the D-type flip-flop logic circuit in the respective counting unit 12. A clock signal terminal CE is configured to connect through the buffer 1 to a second input terminal of an XNOR gate (=) of the first counting unit 12. In any of other counting units beyond the first counting unit, the clock signal terminal CE is connected through the buffer 1 to an input terminal of an AND gate (&) which has an output terminal connected to the second input terminal of a respective XNOR gate (=) in the respective counting unit. Additionally, the AND gate (&) of a particular one (except the first) of the 8 counting units is configured to have an input terminal connected to the terminal $\overline{Q}$ of the D-type flip-flop logic circuit in a previous one of the 8 counting units.

Also referring to FIG. 5, the output sub-circuit 1032 includes an OR gate (≥1) logic circuit. The OR gate (≥1) has 8 input terminals respectively connected to 8 output terminals (Y0, Y1, . . . , Y7) of the subtraction counter 1031. The OR gate (≥1) has an output terminal connected to an input terminal of a voltage-adjust sub-circuit 1033. The voltage-adjust sub-circuit 1033 has an input terminal connected to the output terminal of the output sub-circuit 1032 and an output terminal connected to the first output terminal OUT of the digital-driving circuit. In an embodiment, the voltage-adjust sub-circuit 1033 is configured to adjust a high voltage signal outputted from the OR gate (≥1) to an effective transistor turn-on voltage level. In particular, the effective transistor-turn-on voltage level corresponds to the turn-on voltage level for the driving transistor in the pixel driving circuit.

In some embodiments, the driving transistor Md is provided as an N-type transistor with an effective turn-on voltage level being set to a high voltage level. In this case, the voltage-adjust sub-circuit 1033 is configured to include a level shifter through which the level of the voltage signal outputted from the output sub-circuit 1032, i.e., the OR gate, is adjusted.

In some embodiments, the driving transistor Md is provided as a P-type transistor with an effective turn-on voltage level being set to a low voltage level. In this case, the voltage-adjust sub-circuit 1033 is configured to include an inverter and a level shifter. By setting proper internal circuitry of the inverter, the phase of a voltage signal outputted from the output sub-circuit 1032, i.e., the OR gate, can be inverted and the value of the voltage signal can be further adjusted.

For the pixel driving circuit 01 implemented in the display panel of FIG. 1, it is optional to integrate the digital-driving circuit 10 in each pixel driving circuit 01 of the display panel to a Micro Chip Optionally, the Micro Chip can be disposed to a substrate of the display panel by a chip-transfer process.

Figure 8:
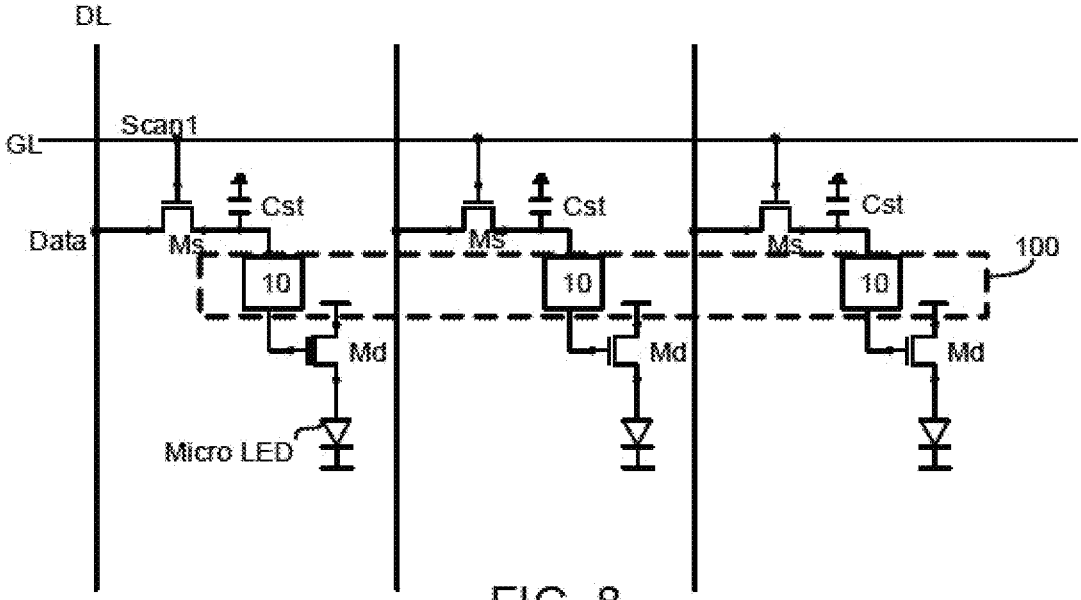
FIG. 8 is a schematic diagram illustrating a pixel driving circuit integrated in a display apparatus according to an embodiment of the present disclosure.
Figure 9:
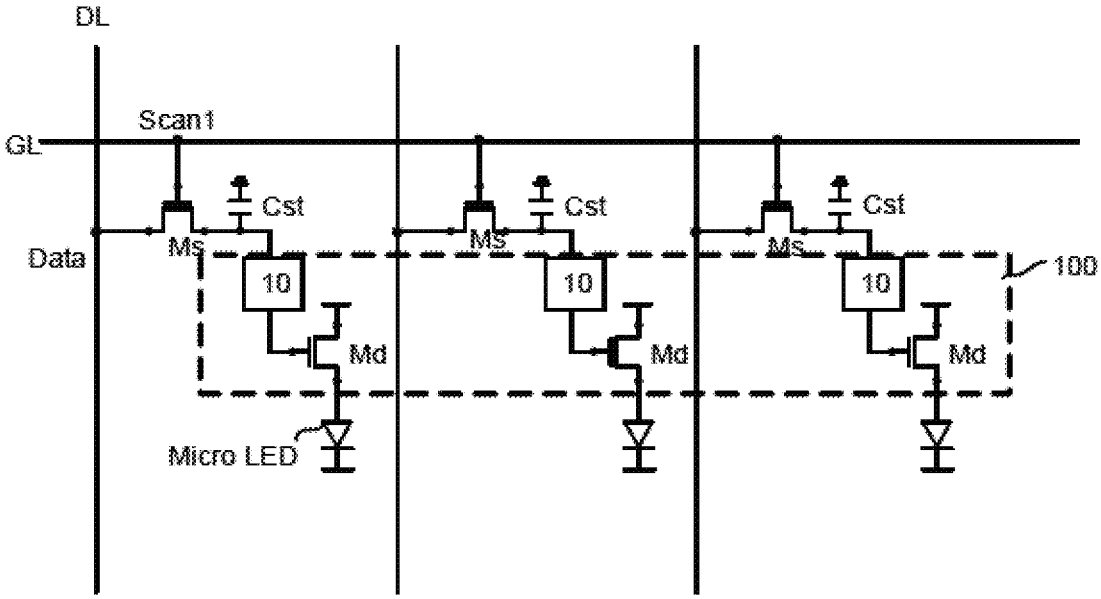
FIG. 9 is a schematic diagram illustrating a pixel driving circuit integrated in a display apparatus according to another embodiment of the present disclosure.

In some embodiments, as shown in FIG. 8, in order to reduce pins of the Micro Chip 100, multiple digital-driving circuits 10 in multiple pixel driving circuits 01 of multiple neighboring subpixels P can be integrated together into a same Micro Chip 100. In some other embodiments, as shown in FIG. 9, multiple digital-driving circuits 10 and respective driving transistors Md in multiple pixel driving circuits 01 of multiple neighboring subpixels P can be integrated together into a same Micro Chip 100. This will facilitate enhancement of image resolution of the display apparatus.

Figure 10:
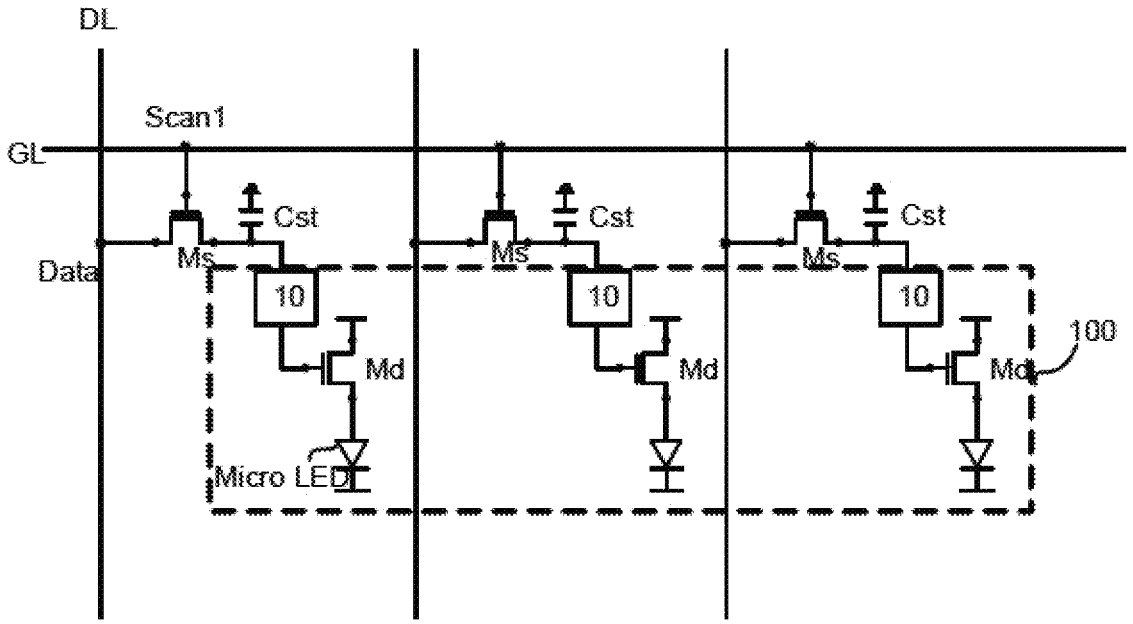
FIG. 10 is a schematic diagram illustrating a pixel driving circuit integrated in a display apparatus according to yet another embodiment of the present disclosure.

In some embodiments, the light-emitting device, e.g., a Micro LED, associated with each subpixel is also disposed to the display panel via a chip-transfer process Optionally, as shown in FIG. 10, the digital-driving circuits 10, the driving transistors Md, and Micro LEDs in multiple pixel driving circuits 01 can all be integrated into a same Micro Chip 100 to simplify manufacture process of the display panel.

The multiple pixel driving circuits 01 integrated in a same Micro Chip can be 2, 3, 4, 5 or more (e.g., as shown in FIG. 8, FIG. 9, and FIG. 10), can belong to different color subpixels (such as red color subpixel, green color subpixel blue color subpixel) in a pixel unit, can belong to multiple neighboring subpixels in different pixel units, and can be multiple neighboring subpixels in one row, in one column, or in multiple rows and multiple columns of the pixel matrix.

Figure 11:
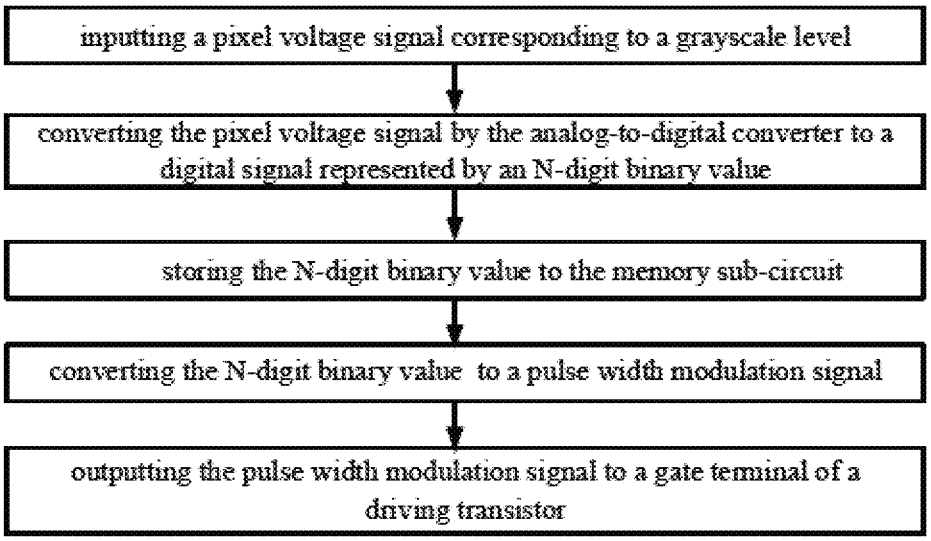
FIG. 11 is a flow chart illustrating a driving method for the pixel driving circuit according to an embodiment of the present disclosure.

In another aspect, the present disclosure provides a driving method for driving the pixel driving circuit 01 described herein. Based on an example (FIG. 4) that the digital-driving circuit 10 in the pixel driving circuit 01 includes an analog-to-digital converter sub-circuit 101, a memory sub-circuit 102, and a pulse-width-modulation sub-circuit 103, the driving method is illustrated in FIG. 11. Referring to FIG. 11, the method includes at least a step of inputting a pixel voltage signal corresponding to a grayscale level. Here, the step of inputting the pixel voltage signal is done by inputting a voltage Vdata to the first input terminal IN The analog-to-digital converter receives the pixel voltage signal Vdata from the first input terminal IN.

Further, the method includes a step of converting the pixel voltage signal by the analog-to-digital converter to a digital signal represented by an N-digit binary value. In an example, N=8, the analog-to-digital converter sub-circuit 101 converts the voltage Vdata, which corresponds to a grayscale level assigned for a respective subpixel, to an 8-digit digital signal. Optionally, the 8-digit digital signal is represented by an 8-digit binary value. Each digit of the 8-digit binary value is respectively outputted through 8 output terminals D0. D1 . . . , D7 (see FIG. 5).

Additionally, the method includes a step of storing the N-digit binary value to the memory sub-circuit 102. The memory sub-circuit 102 includes 8 input terminals respectively to receive 8 digits of the 8-digit binary value from the 8 output terminals D0, D1, . . . , D7. Each digit is then outputted as a digital signal through a buffer 1 to a D-type flip-flop logic circuit 2 in a respective memory unit 11. Each D-type flip-flop logic circuit 2 is configured to output the respective digital signal to a tri-state gate logic circuit 3 by the D-type flip-flop whenever a rising edge of a clock signal CLKA is triggered. The tri-state gate logic circuit 3 under control of an enabling signal OE is configured to respectively output the 8-digit binary value through 8 output terminals Q7, Q6, . . . , Q1, and Q0), as seen in FIG. 5 and FIG. 6. The 8-digit binary value is equal to the grayscale level corresponding to the pixel voltage signal.

Figure 12:
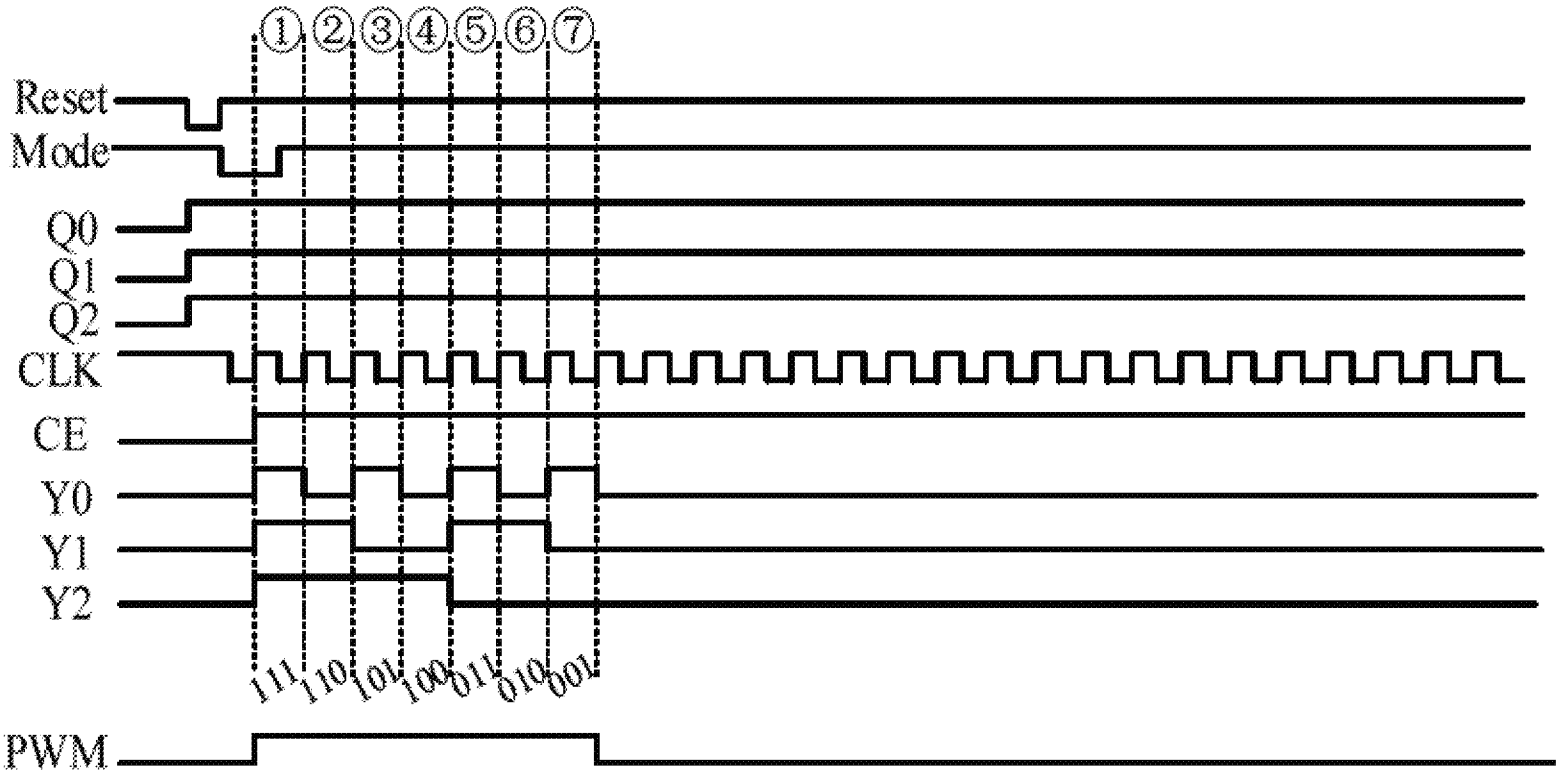
FIG. 12 is a timing diagram for driving a subtraction counter according to an embodiment of the present disclosure.

Furthermore, the method includes a step of converting the N-digit binary value to a pulse width modulation signal. In the example, the pulse-width-modulation sub-circuit 103 receives the 8-digit binary value from the memory sub-circuit 102, processes the 8-digit binary value to generate the pulse width modulation (PWM) signal. In the example, the pulse-width-modulation sub-circuit 103 includes a subtraction counter 1031 (FIG. 5 and FIG. 7), an output sub-circuit 1032 (i.e., an OR gate logic circuit), and a voltage-adjust sub-circuit 1033 for performing the conversion of the 8-digit binary value to the PWM signal. Referring to FIG. 5, FIG. 7, and FIG. 12. The subtraction counter 1031 has 8 input terminals respectively receiving the digital signals from the 8 output terminals (Q7, Q6, . . . , Q1, and Q0) of the memory sub-circuit and a series of counting pulses CLK. Optionally, the subtraction counter 1031 is reset via a reset signal terminal Reset before receiving the digital signals. When a counting pulse CLK (represented by its rising edge) enters its counting period, the subtraction counter 1031 under controls of signals from a preset signal terminal Mode and a clock signal terminal CE performs a subtraction by 1 to the 8-digit binary value till it reaches 0. In this case, within each counting period any one of 8 output terminals of the subtraction counter 1031 will output a high voltage level if the binary value is not 0 yet and will output a low voltage level if the binary value reaches 0. The high or low voltage level will be outputted to an input terminal of an output sub-circuit 1032.

The output sub-circuit 1032 in the pulse-width-modulation sub-circuit receives the outputted signals from the 8 output terminals of the subtraction counter 1031 and outputs continuously a high voltage level before the subtraction counter 1031 counts a value 0 within a respective counting period or outputs continuously a low voltage level once the subtraction counter 1031 starts to count 0 in the counting period.

The voltage-adjust sub-circuit 1033 in the pulse-width-modulation sub-circuit receives outputted signal (either high voltage level or low voltage level) from the output sub-circuit 1032 and is configured to adjust the high voltage level to a transistor-turn-on voltage level that can effectively turn on the driving transistor Md. The voltage-adjust sub-circuit 1033 outputs the effective turn-on voltage level to a gate terminal of the driving transistor.

In an example, for N-type driving transistor Md, the voltage-adjust sub-circuit 1033 can increase the high voltage level from the output sub-circuit 1032 while do not adjust the low voltage level. In another example, for P-type driving transistor Md. The voltage-adjust sub-circuit 1033 can invert the high voltage level from the output sub-circuit 1032 to a low voltage signal and invert the low voltage level from the output sub-circuit 1032 to a high voltage level.

Assuming a pixel voltage signal Vdata corresponding to a grayscale level 7 is inputted to the first input terminal IN, the ADC sub-circuit converts the Vdata to an 8-digit signal, i.e., 00000111. In this case, 8 output terminals (D7, D6, . . . , D1, and D0) outputs respective digits, 0, 0, 0, 0, 0, 1, 1, 1. The memory sub-circuit receives the 8 digits via 8 input terminals and saves them. Further, the memory sub-circuit outputs them via 8 output terminals (Q7, Q6, . . . , Q1, and Q0).

Referring to FIG. 7 and FIG. 12, the subtraction counter 1031 is reset first through a reset signal terminal Reset, then its 8 input terminals respectively receive the digital signal (00000111) via the 8 output terminals Q7, Q6, . . . , Q1, and Q0 as well as based on counting pulses CLK. Under the controls of signals from a preset signal terminal Mode and a clock signal terminal CE, the subtraction counter 1031 performs a subtraction by 1 to the 8-digit digital signal (00000111) whenever one counting pulse comes or is counted by the subtraction counter till the binary digital signal value reaches to 0.

Referring to FIG. 12, which is a timing diagram for driving a subtraction counter according to an embodiment of the present disclosure, in a first counting period [1] corresponding to a digital signal 00000111, among the 8 output terminals, Y0, Y1, Y2 respectively outputs a high voltage level and Y3, Y3, Y4, Y5, Y6, Y7 respectively outputs a low voltage level. In a second counting period [2] corresponding to a digital signal 0000110, Y1, Y2 respectively outputs a high voltage level and Y0, Y3, Y4, Y5, Y6, Y7 respectively outputs a low voltage level. In a third counting period [3] corresponding to a digital signal 00000101, Y0, Y2 respectively outputs a high voltage level and Y1, Y3, Y4, Y5, Y6, Y7 respectively outputs a low voltage level. In a fourth counting period [4] corresponding to a digital signal 00000100, Y2 outputs a high voltage level and Y0, Y1, Y3, Y4, Y5, Y6, Y7 respectively outputs a low voltage level. In a fifth counting period [3] corresponding to a digital signal 00000011, Y0, Y1 respectively outputs a high voltage level and Y2, Y3, Y4, Y5, Y6, Y7 respectively outputs a low voltage level. In a sixth counting period [6] corresponding to a digital signal 00000010, Y1 outputs a high voltage level and Y0, Y2, Y3, Y4, Y5, Y6, Y7 respectively outputs a low voltage level. In a seventh counting period [7] corresponding to a digital signal 00000001, Y0 outputs a high voltage level and Y1, Y2, Y3, Y4. Y5, Y6, Y7 respectively outputs a low voltage level. From the eighth counting period to the 255-th counting period, Y0, Y1, Y2, Y3, Y4, Y5, Y6, Y7 all output a low voltage level.

In this example, the output sub-circuit 1032, e.g., an OR gate logic circuit, is configured to receive a high voltage level from at least one output terminal of the subtraction counter 1031 from the first counting period [1] to the seventh counting period [7]. While, it receives a low voltage level from each output terminal from the eighth counting, period to the 255-th counting period Therefore, a pulse-width-modulation (PWM) signal is generated with a high voltage level for seven counting periods. The PWM signal further is adjusted by the voltage-adjust sub-circuit 1033 to set to an effective turn-on voltage level for the driving transistor Md and is outputted to a gate terminal of the driving transistor Md.

Figure 13:
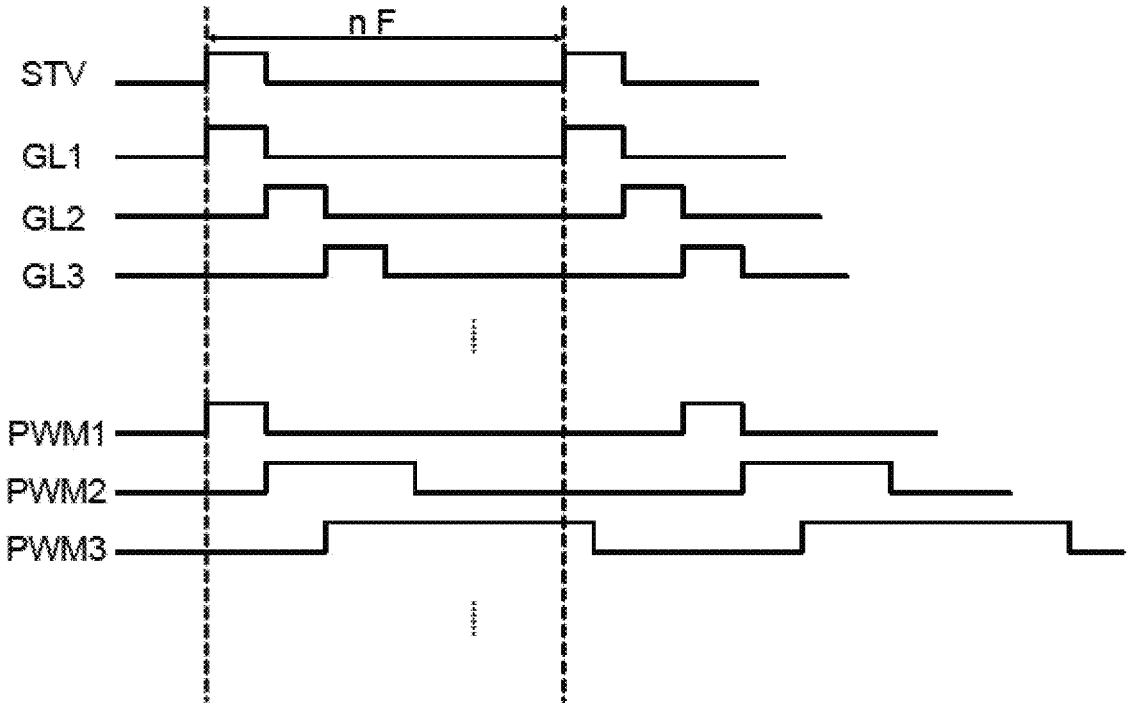
FIG. 13 is a schematic timing diagram for driving a display apparatus according to an embodiment of the present disclosure.

In the embodiment, a display panel of FIG. 1 includes the pixel driving circuit of FIG. 2 that is driven by the method described herein to display frames of images. FIG. 13 shows a schematic toning diagram for driving a display apparatus according to an embodiment of the present disclosure Referring to FIG. 13, when displaying an n-th frame of image in the period nF, the gate driving circuit outputs scan signals line-by-line to gate lines, GL1, GL2, GL3, . . . . In case that one row of gate line receives the scan signal to turn on pixel driving circuits 01 thereof data driving circuit writes pixel voltage signals to respective pixel driving circuits 01 in the row. Respective pixel driving circuits 01 convert the pixel voltage signals to PWM signals, such as PWM1, PWM2, PWM3, . . . . And outputs these PWM signals to respective gate terminals of driving transistors Md. Micro LEDs in this row will be driven respectively by those PWM signals having non-zero duty cycles to emit light with a constant driving current. In this case, a time duration of light emission of a Micro LED is correlated with the duty cycle of a respective PWM signal. Those Micro LEDs controlled by the PWM signals with zero duty cycle will not emit light. In this way, different Micro LEDs are controlled to create different brightness in different grayscale levels solely by the duty cycles of the PWM signals.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel driving circuit for a light-emission-device-based display panel comprising:

a driving transistor coupled to a light-emission device per subpixel;

a digital-driving circuit having a first input terminal configured to receive a pixel voltage signal corresponding to a grayscale level of a subpixel image to be displayed and a first output terminal coupled to a gate terminal of the driving transistor; the digital-driving circuit being configured to convert the pixel voltage signal to a digital signal and transform the digital signal to a pulse-width-modulation (PWM) signal outputted via the first output terminal to the gate terminal of the driving transistor;

wherein the PWM signal comprises a pulse width proportional to the grayscale level as a duty cycle in a period of driving the light-emitting device to display subpixel image; and the digital-driving circuit comprises an analog-to-digital converter sub-circuit coupled to the first input terminal to convert the pixel voltage signal corresponding to generate N binary digits respectively to N output terminals combined to form an N-digit binary value corresponding to the grayscale level.

2. The pixel driving circuit of claim 1, wherein the digital-driving circuit further comprises a memory sub-circuit having N input terminals and N output terminals, the N input terminals being respectively connected to the N output terminals of the analog-to-digital converter sub-circuit and configured to store the N-digit binary value and output respective binary digits to the N output terminals.

3. The pixel driving circuit of claim 2, wherein the memory sub-circuit comprises N memory units, each memory unit comprising a buffer connected to one of the N output terminals of the analog-to-digital converter sub-circuit, a D-type flip-flop logic circuit coupled to the buffer, and a tri-state gate logic circuit coupled to the D-type flip-flop logic circuit and configured to output a respective one of the N binary digits to the N output terminals.

4. The pixel driving circuit of claim 2, wherein the digital-driving circuit further comprises a pulse-width-modulation sub-circuit comprising a subtraction counter having N input terminals and N output terminals, each of the N input terminals being configured to receive one binary (0 or 1) digit and each of the N output terminals being configured to output one binary digit (0 or 1), an OR gate logic circuit having N input terminals respectively connected to the N output terminals of the subtraction counter and an output terminal, a voltage-adjust sub-circuit having an input terminal connected to the output terminal of the OR gate logic circuit and an output terminal coupled to the first output terminal; wherein the subtraction counter contains M counting pulses within each period of displaying a frame of subpixel image.

5. The pixel driving circuit of claim 4, wherein the N-digit binary value is an 8-digit binary value, and M is 255, a maximum value of the grayscale level represented by the 8-digit binary value.

6. The pixel driving circuit of claim 4, wherein the subtraction counter is configured to subtract the N-digit binary value by one till zero per each counting pulse being counted in the subtraction counter and to output a high voltage level at any of the N output terminals corresponding a non-zero digit or output a low voltage level at any of the N output terminal corresponding a zero digit.

7. The pixel driving circuit of claim 6, wherein the voltage-adjust sub-circuit is configured to adjust the high voltage level outputted at any of the N output terminals to an effective transistor turn-on level outputted to the gate terminal of the driving transistor.

8. The pixel driving circuit of claim 1, wherein the pixel driving circuit further comprises a switch transistor having a gate terminal coupled to a scan signal port, a first terminal coupled to a data signal port, and a second terminal coupled to the first input terminal of the digital-driving circuit; and a storage capacitor having a first terminal coupled to the first input terminal of the digital-driving circuit and a second terminal coupled to a first control terminal.

9. The pixel driving circuit of claim 8, wherein the light-emitting device comprises a micro LED, the driving transistor having a first terminal coupled to a first power supply port, a second terminal coupled to a first terminal of the micro LED, and the micro LED having a second terminal coupled to a second power supply port.

10. A display apparatus comprising a plurality of subpixels, at least some of the plurality of subpixels being configured with the pixel driving circuits of claim 1.

11. The display apparatus of claim 10, wherein a respective one of the pixel driving circuits comprises a light-emitting device configured as a micro LED.

12. The display apparatus of claim 11, wherein a respective one of the pixel driving circuits comprises a digital-driving circuit and a driving transistor both being integrated in a micro chip; multiple pixel driving circuits being configured to multiple subpixels disposed next to each other.

13. The display apparatus of claim 11, wherein a respective one of the pixel driving circuits comprises a digital-driving circuit, a driving transistor, and a micro LED, all being integrated in a micro chip; multiple pixel driving circuits being configured to multiple subpixels disposed next to each other.

14. A driving method for driving a pixel driving circuit for a light-emission-device-based display panel, wherein the pixel driving circuit includes a driving transistor coupled to a light-emission device per subpixel; and a digital-driving circuit having a first input terminal configured to receive a pixel voltage signal corresponding to a grayscale level of a subpixel image to be displayed and a first output terminal coupled to a gate terminal of the driving transistor; the digital-driving circuit being configured to convert the pixel voltage signal to a digital signal and transform the digital signal to a pulse-width-modulation (PWM) signal outputted via the first output terminal to the gate terminal of the driving transistor;

wherein the PWM signal comprises a pulse width proportional to the grayscale level as a duty cycle in a period of driving the light-emitting device to display subpixel image;

wherein the digital-driving circuit comprises an analog-to-digital converter sub-circuit, a memory sub-circuit, and a pulse-width-modulation sub-circuit, the method comprising:

inputting a pixel voltage signal corresponding to a grayscale level;

converting the pixel voltage signal by the analog-to-digital converter to a digital signal represented by an N-digit binary value corresponding to the grayscale level;

storing the N-digit binary value to the memory sub-circuit;

converting the N-digit binary value by the pulse-width-modulation sub-circuit to a pulse width modulation signal; and outputting the pulse width modulation signal to a gate terminal of a driving transistor in the pixel driving circuit.

15. The method of claim 14, wherein the pulse-width-modulation sub-circuit comprises a subtraction counter, an OR gate logic circuit, and a voltage-adjust sub-circuit; wherein converting the N-digit binary value to a pulse width modulation signal comprises, receiving each digit of the N-digit binary value from the memory sub-circuit;

subtracting each digit by one per each counting pulse in the subtraction counter till the digit reaches zero; and outputting an output signal at a high voltage level or a low voltage via the OR gate logic circuit whenever a digit in a respective one of N output terminals of the subtraction counter is not zero or is reduced to zero.

16. The method of claim 15, wherein outputting the pulse width modulation signal to a gate terminal of a driving transistor comprises, receiving the output signal from the OR gate logic circuit by the voltage-adjust sub-circuit;

adjusting the high voltage level to an effective transistor turn-on voltage level to generate a pulse width modulation signal having a pulse width proportional to the grayscale level as a duty cycle in a period of displaying a frame of subpixel image; and outputting the pulse width modulation signal to the gate terminal of the driving transistor.

* * * * *